United States Patent [19]

Focke et al.

[11] Patent Number: 4,907,941

[45] Date of Patent: Mar. 13, 1990

[54] APPARATUS FOR FEEDING BLANKS TO A PACKAGING MACHINE

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 82,164

[22] Filed: Aug. 6, 1987

[30] Foreign Application Priority Data

Aug. 16, 1986 [DE] Fed. Rep. of Germany ..... 3627868

[51] Int. Cl.[4] ..... B65H 1/26; B65H 1/30

[52] U.S. Cl. ..... 414/795.8; 271/157; 414/392; 414/416; 414/609

[58] Field of Search ..... 221/11; 271/157; 414/416, 417, 330, 391, 392, 609, 798.9, 795.8

[56] References Cited

U.S. PATENT DOCUMENTS

| | | | |
|---|---|---|---|
| 1,220,375 | 3/1917 | Tanner | 414/392 X |
| 2,869,739 | 1/1959 | Davis | 414/392 X |
| 3,899,068 | 8/1975 | Wallace et al. | 414/609 X |
| 4,260,310 | 4/1981 | Blake et al. | 414/795.8 |
| 4,662,624 | 5/1987 | Focke | 271/157 |

FOREIGN PATENT DOCUMENTS

| | | | |
|---|---|---|---|
| 1099556 | 2/1961 | Fed. Rep. of Germany . | |
| 2423885 | 2/1975 | Fed. Rep. of Germany . | |
| 2440006 | 3/1976 | Fed. Rep. of Germany . | |
| 2532297 | 1/1977 | Fed. Rep. of Germany . | |
| 3141075 | 11/1982 | Fed. Rep. of Germany . | |
| 3313459 | 10/1983 | Fed. Rep. of Germany . | |
| 3307675 | 9/1984 | Fed. Rep. of Germany . | |
| 2555546 | 5/1985 | France . | |
| 248992 | 8/1987 | German Democratic Rep. | 414/330 |
| 390777 | 8/1965 | Switzerland . | |
| 639909 | 12/1983 | Switzerland . | |
| 809292 | 2/1959 | United Kingdom . | |
| 2047663 | 12/1980 | United Kingdom . | |

*Primary Examiner*—Robert J. Spar
*Assistant Examiner*—Janice Krizek
*Attorney, Agent, or Firm*—Sughrue, Mion, Zinn, Macpeak & Seas

[57] ABSTRACT

For supplying a sufficient quantity of prefabricated blanks (21) to packaging machines (20), blank stacks (22) are brought up to the packaging machine (20) on a stack pallet (25). By the use of at least one stack conveyor (27), the blank stacks (22) are taken off from the stack pallet (25) in succession and conveyed to a blank magazine (23) of the packaging machine (20).

10 Claims, 11 Drawing Sheets

62
61
63
64
60
65
37
49
56
36
33
37
22
38
32
43
55
75
45
20
56
44
41
42
28
29
25
36
35
50
74

22
31
28
29
25
26
36
35
73
74
37
34
45
49
60
47
64
61
63
62
68
72
71
38
20
42

APPARATUS FOR FEEDING BLANKS TO A PACKAGING MACHINE

BACKGROUND OF THE INVENTION

The invention relates to an apparatus for feeding blanks to a packaging machine, especially for the production of hinge-lid (cigarette) packs, the blanks produced elsewhere being fed as a blank stack to a blank magazine located at the machine, and individual blanks for producing the packs being extracted from this.

On packaging machines with a high production capacity, especially on cigarette-packaging machines, the sufficient availability of blanks presents a particular problem. When packs are made of relatively thick packaging material (cardboard), it is often customary to manufacture individual blanks separately from the packaging material and feed blank stacks to the packaging machine. It is particularly important, here, that a sufficient stock of blanks should be formed in the region of the packaging machine and supplemented to the necessary degree.

SUMMARY OF THE INVENTION

The object on which the invention is based is to provide an apparatus for driving a stock of blanks to be fabricated elsewhere and carry them to a packaging machine; the blanks are transferred automatically, as required, from a larger stock of blanks for a blank magazine belonging to the packaging machine.

To achieve this object, the apparatus according to the invention is characterized in that, at any particular time, several blank stacks can be advanced to the packaging machine on a transportable stack carrier (stack pallet) and can be successively extracted from the stack carrier and fed to the blank magazine by means of a stack conveyor.

Stack carriers (stack pallets) with a large capacity are loaded at a suitable central point with blank stacks which are arranged in closely packed rows on the stack carrier. The stack carriers are movable, in particular by means of rollers on rails, and can thus be advanced to the respective packaging machine.

The stack carriers assume a predetermined exact (variable) relative position in relation to the packaging machine, in such a way that blank stacks can be removed in succession from the stack carrier, as required, by the stack conveyor and conveyed to the blank magazine located at the machine. The stack carrier is preferably arranged at the rear of the packaging machine. The stack conveyor transports the blank stacks to the front of the packaging machine, where the blank magazine is arranged in an upper region. Accordingly, the stack conveyor consists of an elevator located at the rear of the packaging machine, a cross-conveyor following this above the packaging machine, and a lowering conveyor leading to the blank magazine.

The elevator is equipped with a stack pick-up for each blank stack, preferably an upper and a lower clamping jaw movable relative to one another. A particular blank stack is grasped between the clamping jaws and conveyed upwards.

The stack carriers are designed in a special way. In the region of a supporting base, there are lateral (along the longitudinal edge) recesses, through which the lower clamping jaw of the elevator can pass in order to pick up or take up the stack. A recess of this type is assigned to each row of the blank stacks. As a result of a shift of the (part) rows on the stack pallet or as a result of the movement of the latter, the blank stacks are brought successively into the pick-up position for the stack conveyor.

The apparatus according to the invention is also designed for two-track operation of the packaging machine. In this case, according to a proposal of the invention, there is a branch in the region of the stack conveyor, preferably at the transfer from the elevator to two crossconveyors running next to one another.

Alternatively, in order to increase the output, two stack carriers (stack pallets) can be advanced to the packaging machine, a separate stack conveyor being assigned to each stack pallet.

Further features of the invention relate to the design of the stack carriers (stack pallets) and to the conveyors for transporting the blank stacks.

Exemplary embodiments of the invention are explained in detail below with reference to the drawings. In these:

DETAILED DESCRIPTION OF PREFERRED EMBODIMENTS

Figure 1:
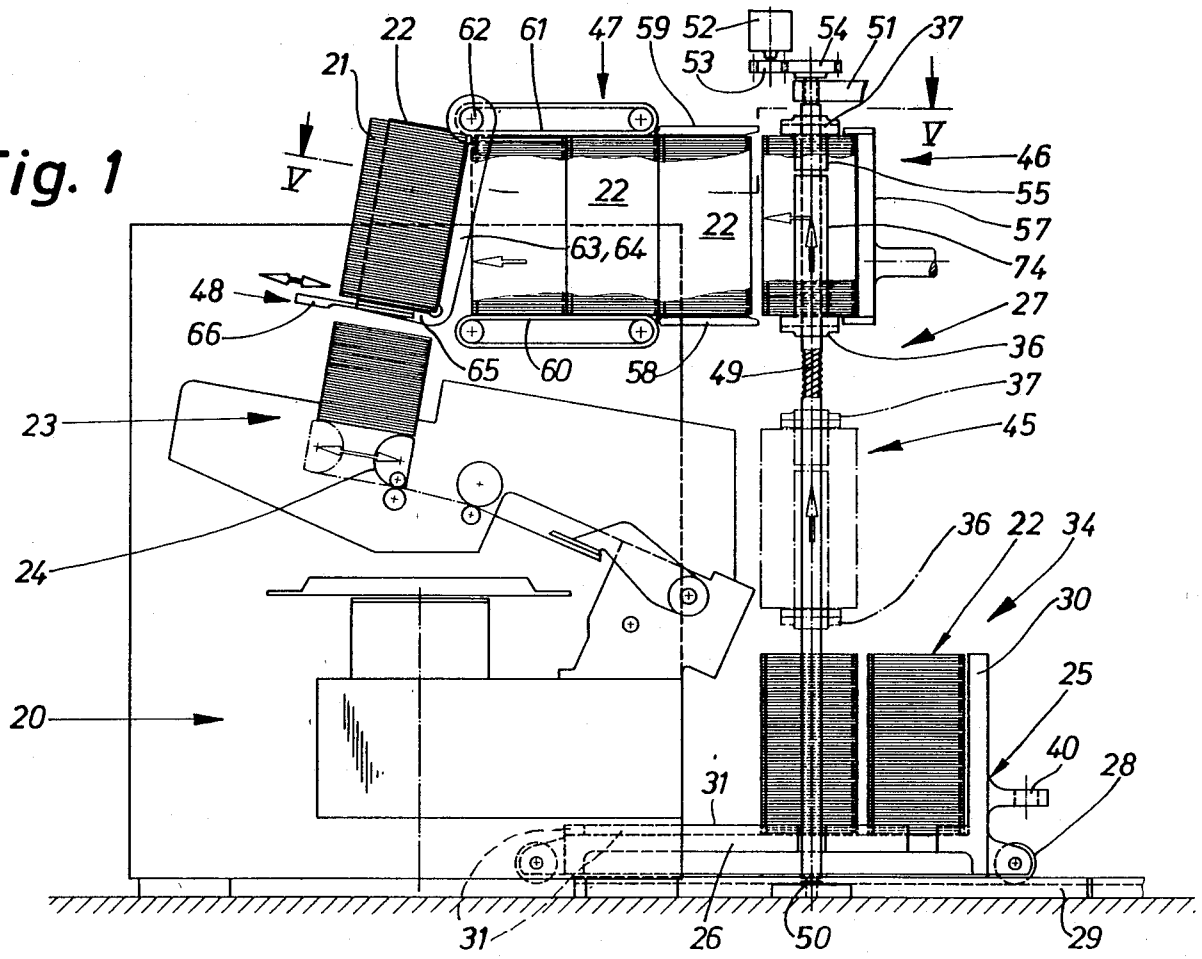
FIG. 1 shows a diagrammatic side view of the apparatus for storing blank stacks and transferring them to a packaging machine.

The exemplary embodiments illustrated relate to the feeding of a packaging machine 20 for cigarettes with blanks 21. The blanks 21 made elsewhere by being punched from cardboard-like packaging material serve for producing hinge-lid packs. The conventionally shaped blanks 21 are combined into blank stacks 22 consisting of a relatively large number of blanks 21. These blank stacks 22 are conveyed in succession to a blank magazine 23 belonging to the packaging machine 20. The individual blanks 20 are extracted from the blank magazine 23 on the underside and introduced into the packaging process. In the present case, a rolling-off device 24 of known design is provided for extracting the blanks 21.

The principal component of the apparatus for feeding the packaging machine 20 with blanks 21 is a stack carrier, here designed as a stack pallet 25. The blank stacks are stored on this, namely on a base plate 26, until they are taken off by a stack carrier 27.

The stack pallets 25 are loaded at a central point and fed to the packaging machine 20, in the present case at the rear of this, so that access to the front of the packaging machine 20 is not impeded. The stack pallet 25 is movable by means of wheels 28, in the present case on running rails 29 attached to the floor.

The stack pallet 25, rectangular as seen in horizontal projection, is equipped at the rear with a supporting wall 30, approximately at the height of the blank stack 22. On the remaining sides, a rim 31 of less overall height is provided all around, in order to secure the blank stacks 22 on the base plate 26. In the present exemplary embodiment, the dimensions of this are such that 28 blank stacks 22 are accommodated. Each blank stack 22 has a height of approx. 450 mm. This results in a load of the stack pallets 25 corresponding to approximately 1 hour's requirement of blanks for the packaging machine 20 at a machine output of 700 packs per minute.

The blank stacks 22 are arranged on the base plate 26 in transverse stack rows 32, 33 placed close to one another. The blanks 21 have their longitudinal extension directed transversely relative to the stack rows 32, 33. The blank stacks 22 are lifted off in succession from the stack pallets 25 in the region of a discharge station 34 by the stack conveyor 27. This is located in the region of the discharge station 34. The stack pallets 25 are so positioned and movable relative to the discharge station 34 that the blank stacks 22 can each be received along a longitudinal edge of the stack pallet 25.

For this purpose, the stack pallet 25 on its base plate 26 is provided laterally, in particular along one longitudinal side, with recesses 35 which, in the present exemplary embodiment, are T-shaped as seen in horizontal projection. The recesses 35 are open towards the sides. In the region of the recesses 35, the stack pick-up of the stack conveyor 27 can grasp the blank stack 22 from below and carry it in the upward direction. In the present exemplary embodiment, the pick-up for a blank stack 22 consists of two (upper and lower) clamping jaws 36 and 37, between which a particular blank stack 22 is received. Clamping jaws 36, 37 are movable away from one another and together in order to grasp and release the blank stack 22. In the present case, the lower clamping jaw 36 passes from below through the particular recess 35 of the base plate 26 located at the discharge station 34 and thus discharges the blank stack 22 resting in the region of this recess 35.

Figure 6:
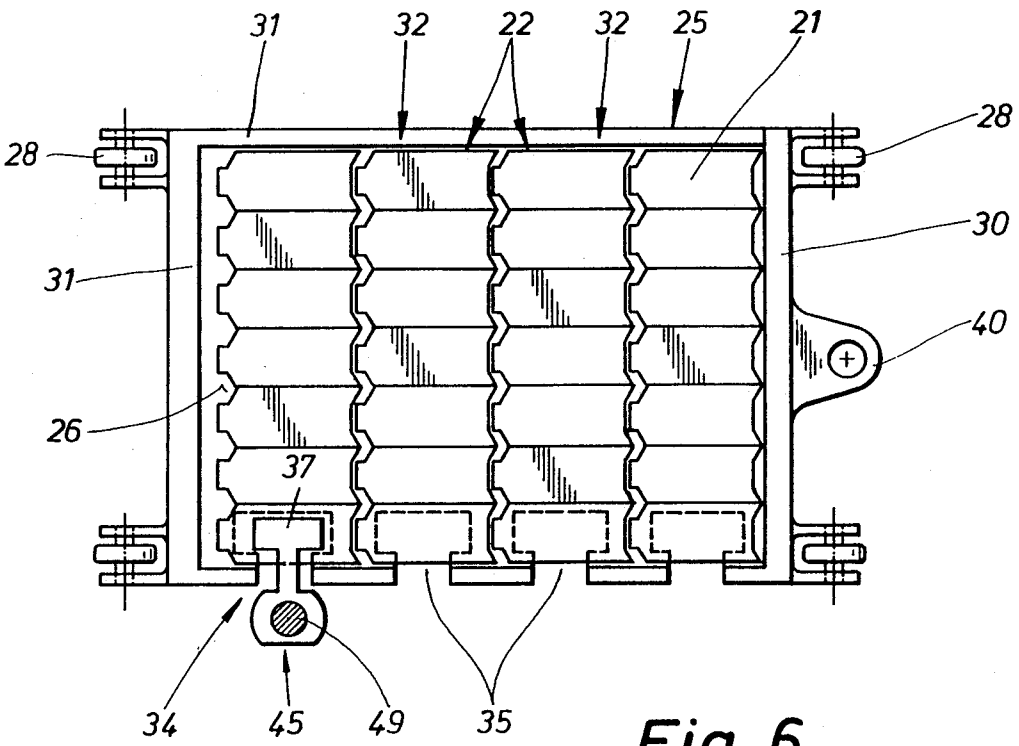
FIG. 6 shows a plan view of a stack carrier (pallet) in the loaded state.
Figure 7:
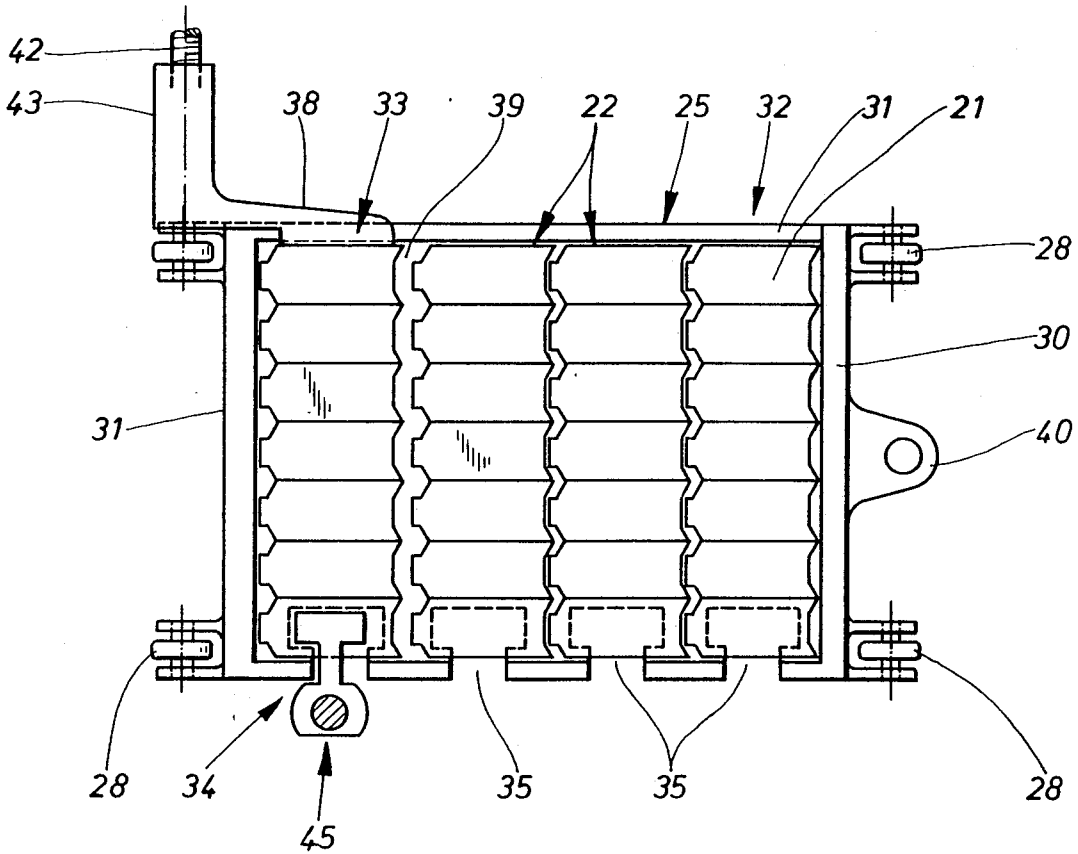
FIG. 7 shows a representation similar to that of FIG. 6, after the preparation of a first row of blank stacks for take-over by a stack conveyor.

The blank stacks 22 on the stack pallets 25 are moved successively into the region of the discharge station 34. For this purpose, at least the particular stack row 33 to be discharged is released from the remaining stack rows 32 on the stack pallet 25, so that the blank stacks 22 of this are free. To this effect, the blank stack 22 located in the discharge station 34 and positioned at the edge of the respective stack row 33 is retained between the clamping jaws 36, 37. On the opposite side of the stack rows 33, a transverse slide 38 is activated. This comes up against the outer face of the outer blank stack 22 of this stack row 33. As a result of transverse pressure exerted by the transverse slide 38, the complete stack row 33 is compressed and thus fixed as a single unit. The stack pallet 25 can now be moved back a little way, in the present case from the position according to FIG. 6 into the position according to FIG. 7. As a result, because of the clearance on the base plate 26 the (front) stack row 33 is released from the following one, thereby forming a transverse gap 39. At the same time, the likewise T-shaped clamping jaws or the lower clamping jaw 36 is shifted relatively in the recess 35 of the discharge station 34, in particular likewise from the position according to FIG. 6 into that according to FIG. 7. The recesses 35 have appropriately large dimensions. After a slight retraction of the transverse slide 38 and consequently the removal of the transverse pressure, the first blank stack 22 located at the edge of this stack row 33 can now be conveyed upwards.

Figure 8:
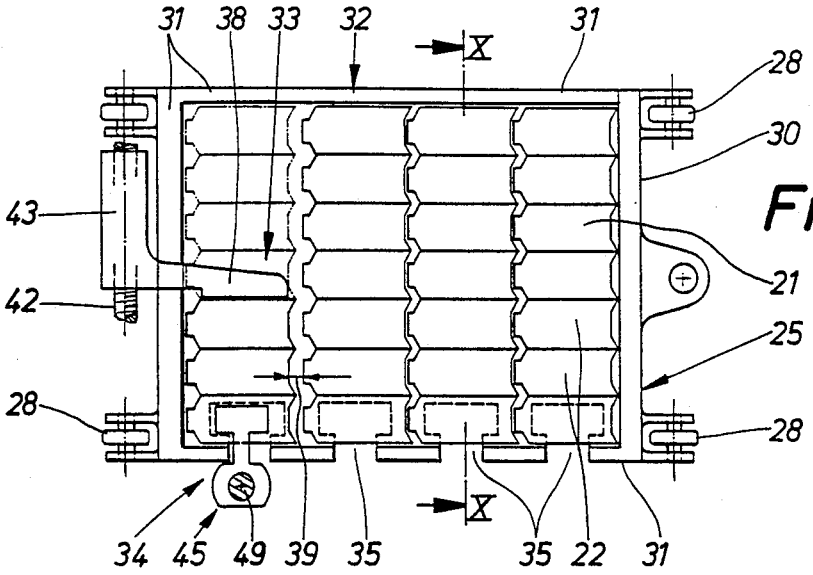
FIG. 8 shows a representation of the stack carrier according to FIG. 6 and 7 after the discharge of several blank stacks.
Figure 9:
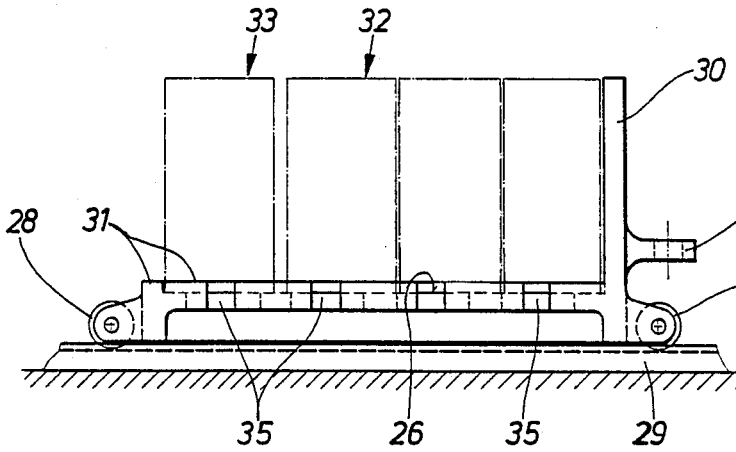
FIG. 9 shows a side view of a stack carrier (stack pallet)
Figure 10:
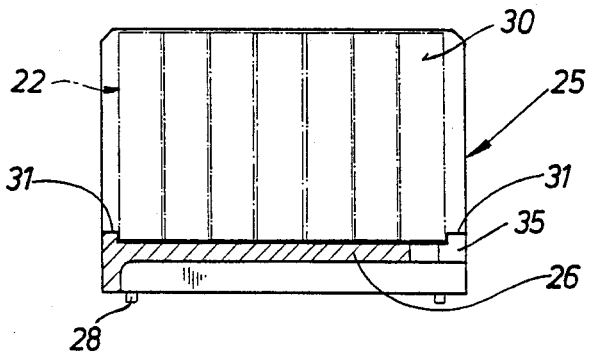
FIG. 10 shows a cross-section through a stack pallet in the sectional plane X—X of FIG. 8.

In order to discharge the further blank stacks 22 of this (front) stack row 33, the remaining blank stacks 22 of the latter are shifted successively in the direction of the discharge station 34 by the transverse slide 38 (see FIG. 8). When this stack row 33 has been removed completely, the same procedure is adopted for the next one, the stack pallet 25 first being moved further a stroke corresponding to a stack row 32.

By means of appropriate devices the stack pallet 25 can be advanced (automatically) to the packaging machine 20 and moved to and fro in the region of the latter to the extent described. For this purpose, a clip 40 for fastening a drive member is attached to the rear side of the stack pallet 25 or to its supporting wall 30.

In the present case, the angular transverse slide 38 is displacable by means of a spindle mechanism. Part of the transverse slide 38 is mounted as a spindle nut 43 on an elongate spindle 42 mounted fixedly on a gear casing 41. The spindle 42 is driven to rotate by means of a motor 44.

In the exemplary embodiments illustrated, the stack conveyor 27 consists of several individual conveyors adjoining one another. An elevator 45 is arranged in the region of the discharge station 34. In a region above the packaging machine 20, in particular in a transfer station 46, there follows a cross-conveyor 47 which leads transversely over the packaging machine 20 to the front of the latter. The blank stacks 22 are transferred from this cross-conveyor 47 to a lowering conveyor 48. This is followed to the bottom by the blank magazine 23.

The elevator 45 can be designed in various ways. In the present exemplary embodiment, it is a spindle conveyor with a fixed vertical spindle 49. This is mounted rotatably in a floor bearing 50 and likewise rotatably in an upper supporting bearing 51 which is connected in a suitable way to the structure of the packaging machine 20. The rotary drive of the spindle 49 is effected in the region of the upper supporting bearing 51 by means of a servo-motor 52 with a pinion 53 via a gear wheel 54.

The lower clamping jaw 36 is mounted on the spindle 49 by means of an elongate spindle nut 74. When the spindle 49 rotates, the lower clamping jaw 36 is thus moved up and down. The upper clamping jaw 37 is likewise mounted slideably on the spindle 49 by means of a guide sleeve 55, but without engagement with the thread of the spindle 49. In this way, this upper clamping jaw 37 can also be moved upwards by means of or together with the spindle nut 74. The spindle nut 74 and the guide sleeve 55 are designed with telescopic ends 56. These overlap one another when the clamping jaws 36 and 37 are in the clamping position. The manner in which these are actuated is not shown for the sake of this simplified representation. For example, the upper clamping jaw 37 can be moved relative to the lower clamping jaw 36 by means of a pressure-medium cylinder, and the clamping force can be transmitted in this way.

In the region of the transfer station 46, the upper clamping jaw is released in an upper end position after reaching the lower clamping jaw. The blank stack 22 can now be pushed off the lower clamping jaw 36 in transverse direction by means of a pushing-off device 57. On the upper side located opposite the platform 58, the blank stack 22 is fixed by a cover plate 59.

After the platform 58, the blank stacks 22 pass between upper and lower central conveyor belts 60 and 61. The blank stacks 22 are transported in the region of the platform 58 by means of the pushing-off device 57. The conveyor belts 60 and 61 are driven, so that the blank stacks 22 are transported in the direction of the arrow.

Figures 2, 2A:
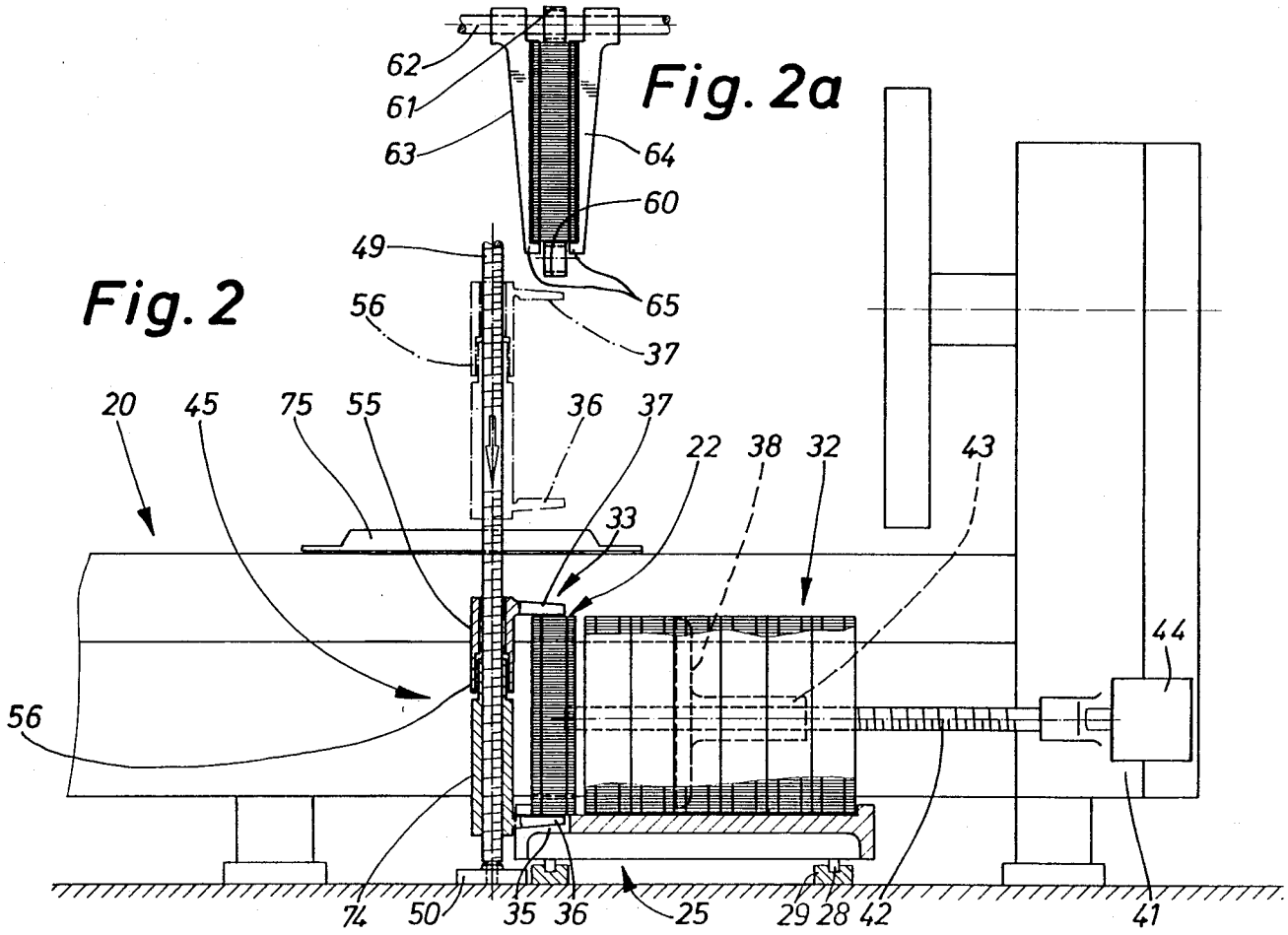
FIG. 2 shows a transverse view of the apparatus according to FIG. 1, with parts of the packaging machine omitted.
FIG. 2*a* shows a detail of the apparatus in a view offset 90° relative to FIG. 2.
Figure 3:
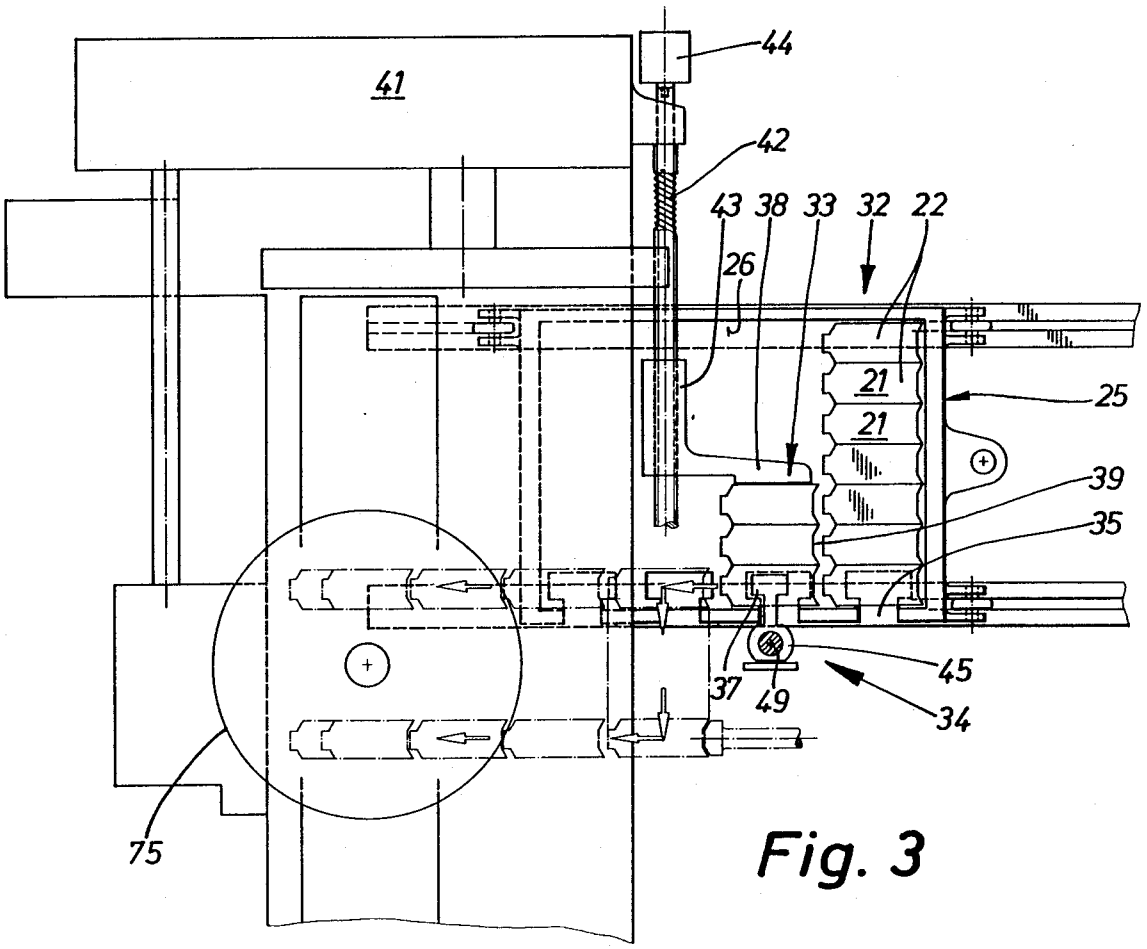
FIG. 3 shows a plan view of the apparatus in a lower plane (above a stack carrier)

A transfer member for the blank stacks 22 is located at the end of the cross-conveyor 47 and of the conveyor belts 60, 61. Two supporting arms 63 and 64 are mounted pivotably on a transversely directed supporting rod 62 (FIG. 2*a*). These are equipped, at the lower ends, with transversely directed supporting legs 65, on which a blank stack 22 is received when it leaves the conveyor belts 60, 61. For this purpose, the supporting arms 63, 64 are moved away from one another on the supporting rod 62 by means of a suitable drive member (for example a pressure-medium cylinder), so that the blank stack 22 can be conveyed into the region between the supporting arms 63, 64. When the supporting arms 63, 64 are brought together into the position according to FIG. 2*a*, the blank stack 22 is consequently grasped, and at the bottom it rests on the supporting legs 65 angled inwards and forwards. Owing to the shape of the supporting arms 63, 64 (angular cross-section), the blank stack 22 is grasped laterally and also at the rear over its entire height.

As a result of a pivoting movement of the supporting arms 63, 64, the blank stack 22 is brought into an inclined position (FIG. 1). A lowering conveyor 48 can now receive the blank stack and feed it to the blank magazine 23. In the present case, the lowering conveyor 48 is designed as a supporting web 66 movable up and down also upwards and backwards. This is moved under the blank stack 22 held by the supporting arms 63, 64 (FIG. 1). After the supporting arms 63, 64 have been moved away from one another, the blank stack 22 is fed to the blank magazine 23 as a result of a downward movement of the supporting web 66. The supporting web 66 is then retracted, moved into the upper position and brought under the next blank stack 22. The design and drive of the supporting web 66 correspond essentially to those of the member used for the same purpose in the subject of patent application DE-A-3,402,514.

Figure 4:
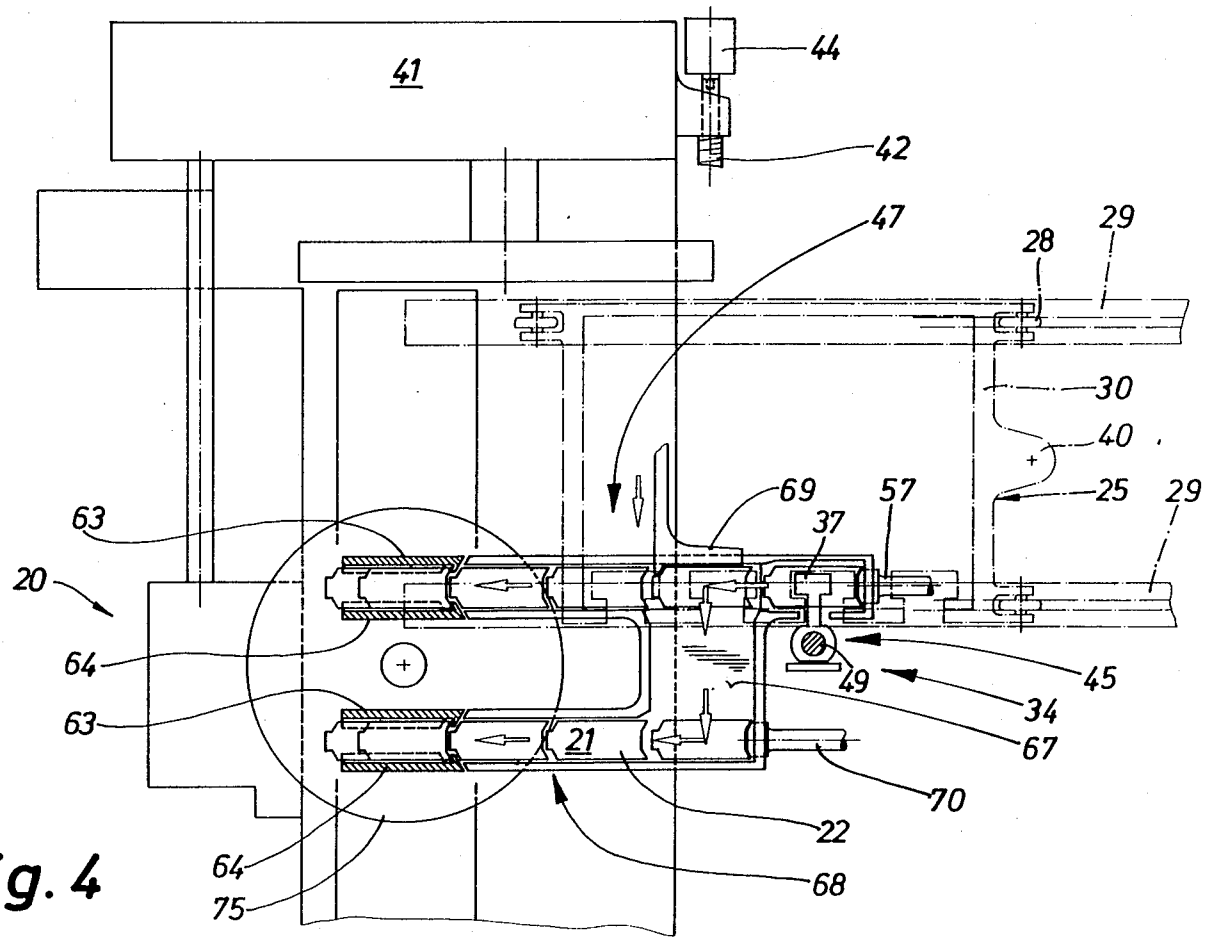
FIG. 4 shows a plan view in an upper plane (in the region of cross-conveyors)
Figure 5:
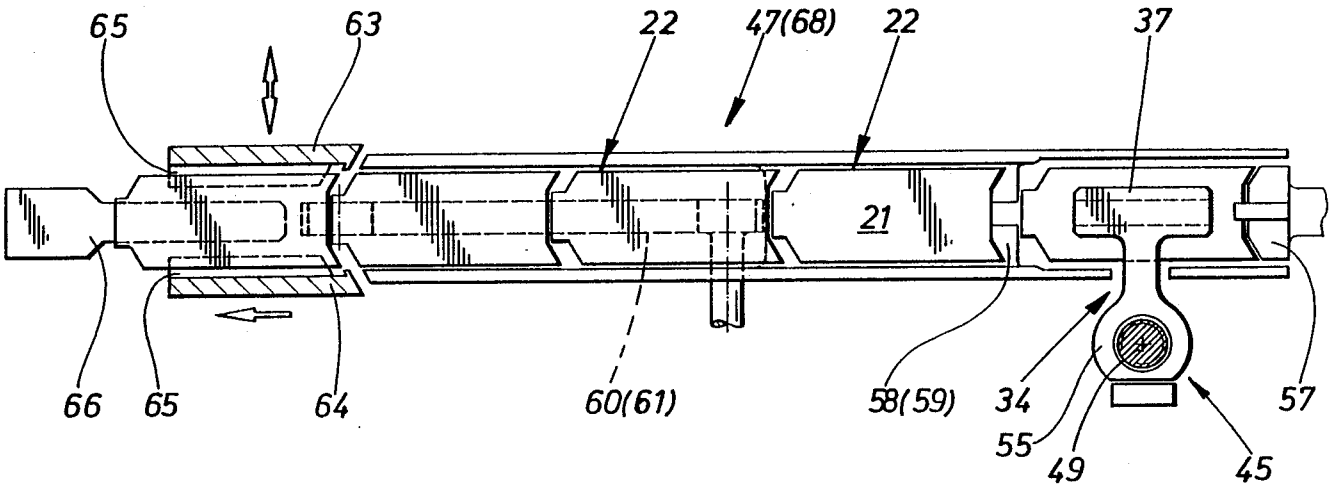
FIG. 5 shows a cross-conveyor as a detail in horizontal projection, on an enlarged scale (sectional plane V—V in FIG. 1)

The productivity of the apparatus can be increased as shown in the exemplary embodiment of FIG. 4 by blank stacks 22 being conveyed into two tracks in the region of the cross-conveyor 47 and thereafter. For this purpose, the first cross-conveyor 47 of the design described is arranged after the transfer station 46. The connecting platform 67 leads transversely from this to a second crossconveyor 68. This is of a design identical or similar to that of the cross-conveyor 47 described. The blank stacks 22 delivered by the elevator 45 are fed alternately to the cross-conveyor 47 and the cross-conveyor 68. The transverse movement to the latter is executed by means of a slide 69 which conveys blank stacks 22 via the connecting platform 67 to the cross-conveyor 68 from the free side in the region of the platform 58. A pushing-off device 70 corresponding to the pushing-off device 57 is assigned to the cross-conveyor 68. The further conveyor members, in particular the lowering conveyor 48, and the blank magazine 23 are likewise duplicated.

Figures 11, 11A:
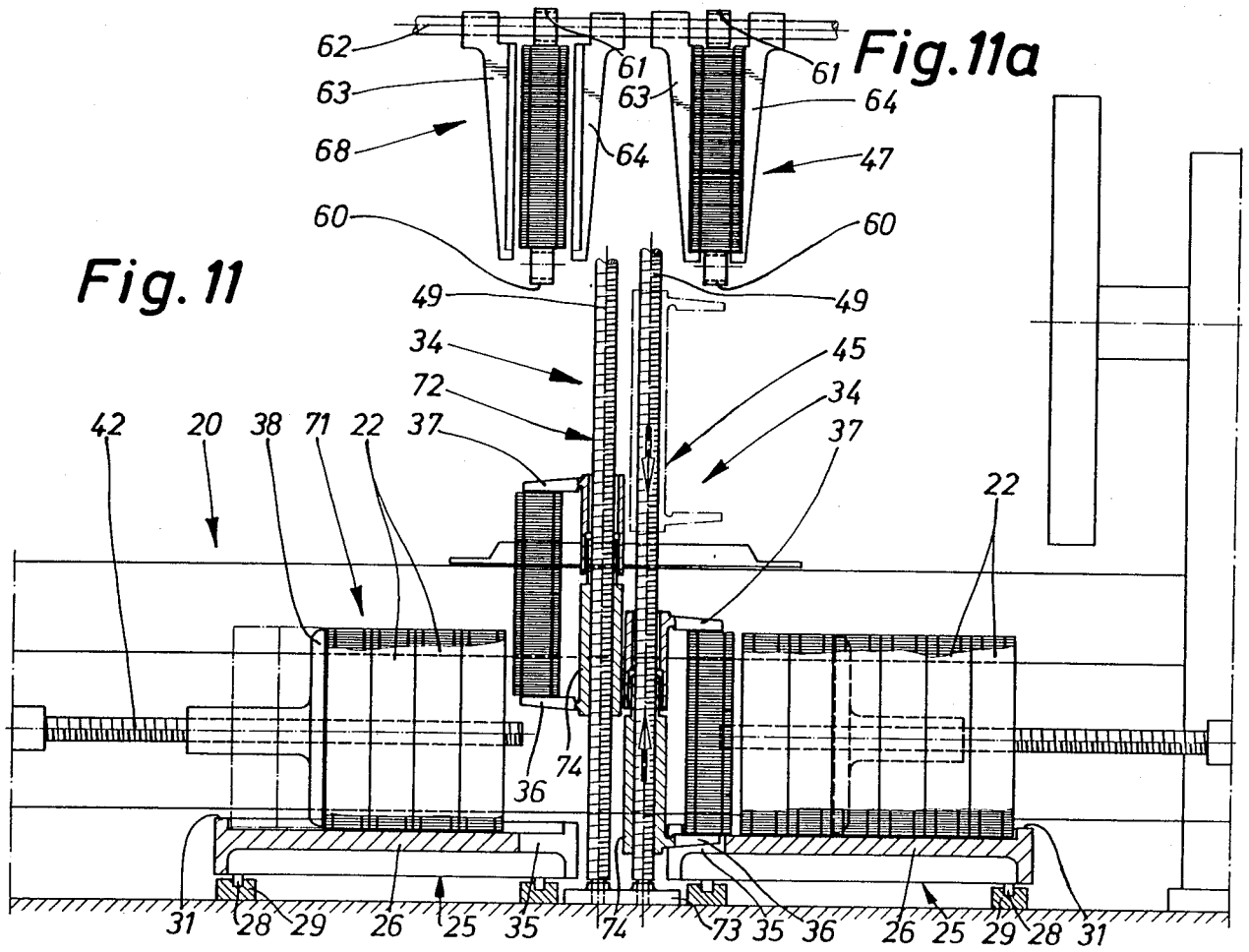
FIG. 11 shows a representation similar to that of FIG. 2 for a version of the apparatus with two stack carriers and separate stack conveyors.
FIG. 11*a* shows a detail of the exemplary embodiment according to FIG. 11 in a view offset 90°.
Figure 12:
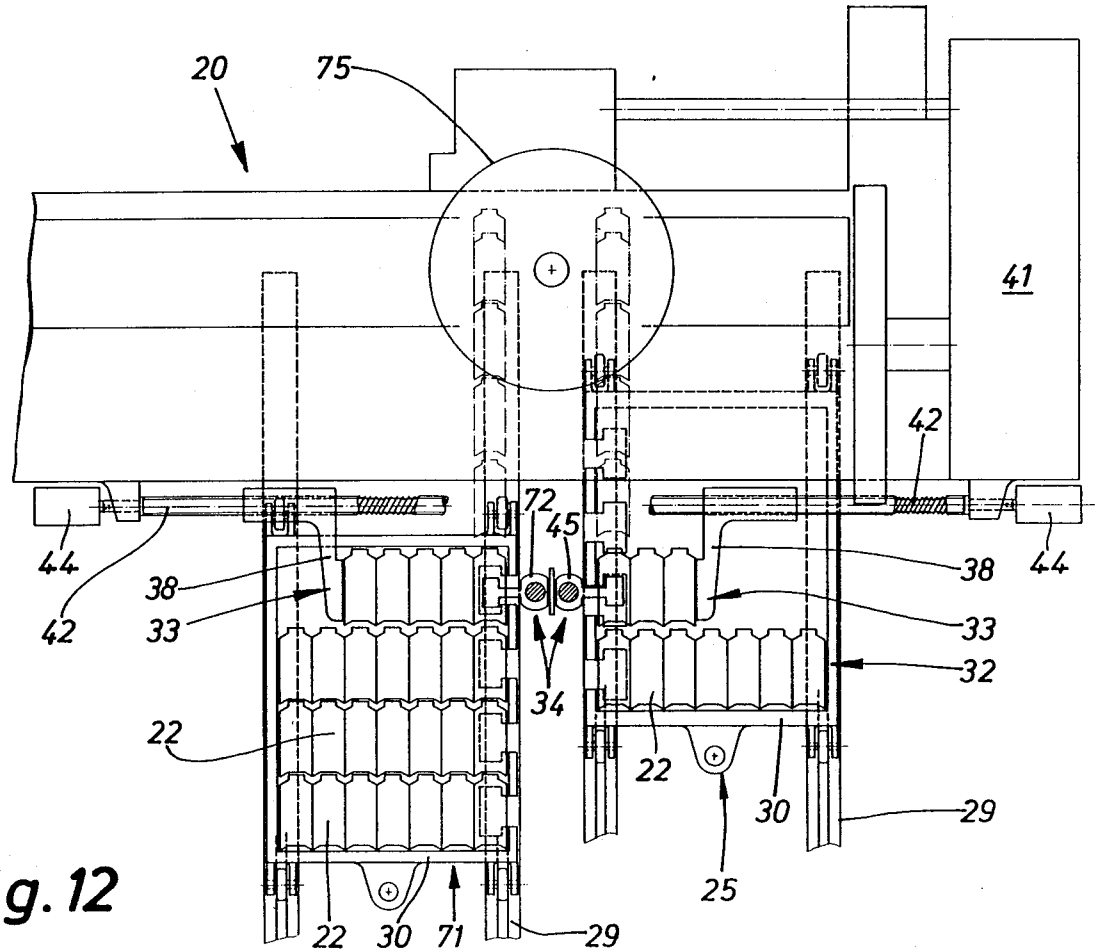
FIG. 12 shows a plan view of the apparatus according to FIG. 11.
Figure 13:
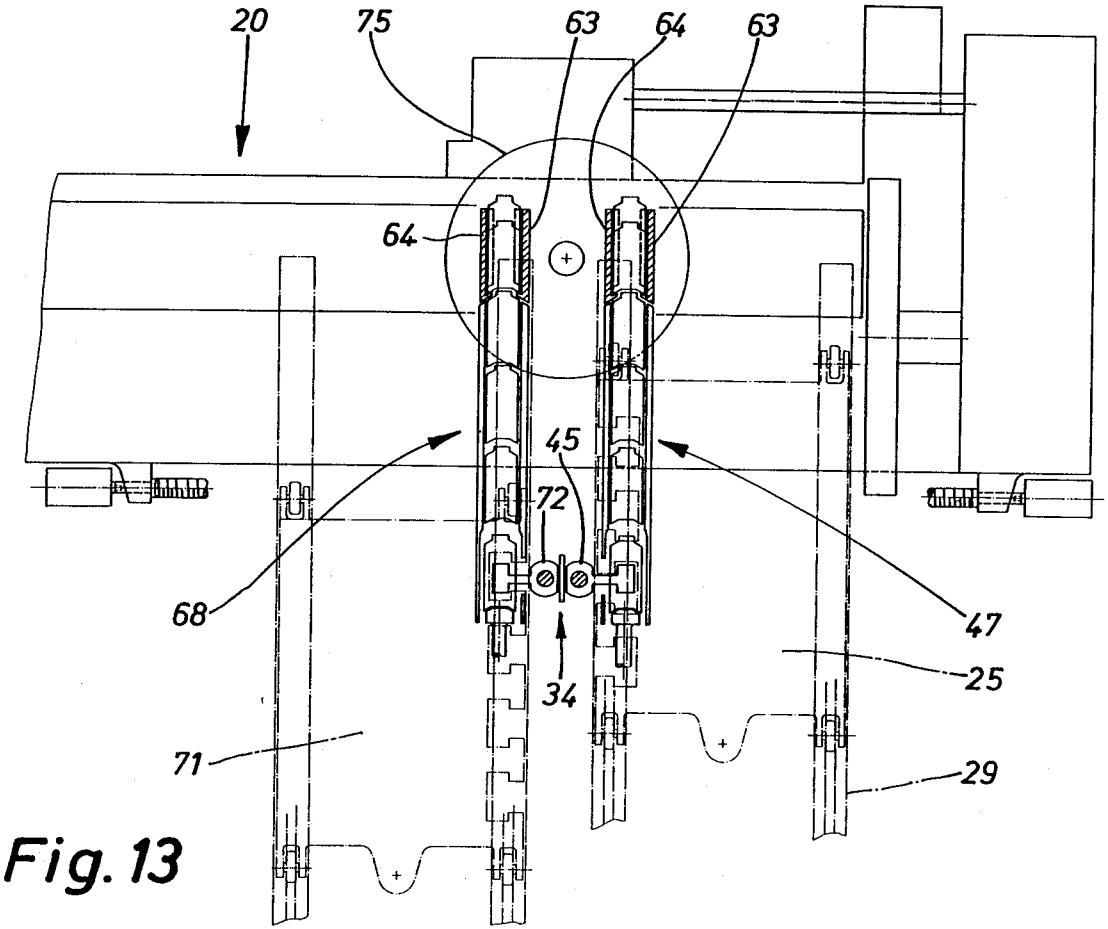
FIG. 13 shows a plan view of the apparatus according to FIGS. 11 and 12 in an upper plane (crossconveyor).

FIGS. 11 to 13 show details of an apparatus, in which a first stack pallet 25 with blank stacks 22 is advanced to the packaging machine 20 (to its rear) in the way described, and a further second stack pallet 71. This stack pallet 71 is of the same design as the stack pallet 25 described. Furthermore, this second stack pallet 71 is assigned a separate elevator 72 which is of the same design as the elevator 45 already described. The arrangement is such that the clamping jaws 36, 37, each movable on a spindle nut 74 and belonging to the two elevators 45 and 72 are directed away from one another, so that the stack pallets 25 and 71 can be advanced from opposite sides to the elevators 45 and 72 arranged immediately adjacent to one another. The spindles 49 of these are arranged at a slight distance from one another and are supported rotatably on a common floor bearing 73.

Each of the elevators 45, 72 conveys the blank stacks 22 to a cross-conveyor and to a lowering conveyor in the way described. Accordingly, two separate stack conveyors are used here, and these can be operated independently of one another.

Details of the apparatus can be designed differently from those of exemplary embodiments illustrated. Thus, the pack pallets 25 can have assigned to them an upper cover plate which, in the region of the discharge station 34, has a suitable recess for the passage of a particular blank stack 22. The cover plate keeps the remaining or neighbouring blank stacks 22 from being lifted together with it.

The apparatus described can be used to particular advantage in conjunction with a packaging machine for hingelid packs according to German Patent P 24 40 006. This packaging machine is equipped with a folding turret 75 which is rotatable about a vertical axis and which is illustrated diagrammatically in the drawings. The blank magazine 23 or the blank magazines are arranged above the folding turret 75, so that the blanks can be fed to the folding turret 75 in the way described in Patent P 24 40 006.

We claim:

1. Apparatus for feeding blanks to a packaging machine for the production of hinge-lid cigarette packs, the blanks being fed as a blank stack to a blank magazine located at the machine, and individual blanks for producing the packs being extracted from said blank magazine, said apparatus comprising;

a stack pallet for carrying a plurality of blank stacks and for advancing said plurality of blank stacks to the packaging machine;

a stack conveyor, assigned to the packaging machine in a fixed relationship, for successively extracting blank stacks from said stack pallet and for feeding said blank stacks to said blank magazine; and a discharge conveyor station comprising means for shifting blank stacks of a particular stack row and for feeding said blank stacks into said stack conveyor, and further comprising means for shifting said stack pallet in steps for positioning one particular stack row after the other adjacent to said stack conveyor;

wherein, for the picking up of blank stacks (22) from the stack pallet (25), the stack conveyor (27) has an elevator (45) with a stack pickup in the form of lower and upper clamping jaws (36, 37) between which the blank stack (22) is received; and wherein, at least one cross-conveyor (47, 68) extends above the packaging machine (20) and consists of upper and lower conveyor belts (60, 61), for transporting the blank stack (22) from the elevator to the working side of the packaging machine (20).

2. Apparatus according to claim 1, characterized in that, adjacent to the end of the cross-conveyor (47, 68) and to the end of the conveyor belts (60, 61), is a lowering conveyor (48) for conveying the blank stacks (22) to the blank magazine (23), said lower conveyor comprising a supporting web (66) which is movable up and down and movable transversely and on which a blank stack (22) rests during downward movement.

3. Apparatus according to claim 2, characterized in that, at the delivery end of the conveyor belts (60, 61) of the crossconveyor (47, 68), is arranged a pick-up and transfer member for the blank stacks (22), in the form of two pivotable lateral supporting arms (63, 64) with supporting legs (65), in which the blank stack (22) rests after being delivered by the conveyor belts (60, 61), the supporting arms (63, 64) being pivotable out of a pick-up position into a delivery position.

4. Apparatus according to claim 1, characterized in that, two cross conveyors (47, 68) are arranged parallel and next to one another and are fed by means of a common elevator (45), the cross-conveyors (47, 68) being connected to one another by means of a connecting platform (67) for transferring blank stacks (22).

5. Apparatus according to claim 1, comprising two or more stack pallets (25, 71) advanceable independently of one another, and a separate stack conveyor (27) assigned to each stack pallet (25, 71).

6. Apparatus for feeding blanks to a packaging machine for the production of hinge-lid cigarette packs, the blanks produced elsewhere being fed as a blank stack to a blank magazine located at the machine, and individual blanks for producing the packs being extracted from the magazine, characterized in that, at any particular time, several blank stacks (22) can be advanced to the packaging machine (20) on a transportable stack pallet (25) and can be successively extracted from the stack pallet (25) and fed to the blank magazine (23) by means of at least one fixed stack conveyor (27) assigned to the packaging machine (20); characterized in that, for the picking up of a blank stack (22) from the stack pallet (25), the stack conveyor (27) has an elevator (45) with a stack pick-up in the form of lower and upper clamping jaws (36, 37) between which the blank stack (22) is received; and that at least one cross-conveyor (47, 68) extends above the packaging machine (20) and consists of upper and lower conveyor belts (60, 61), for transporting the blank stack (22) from the elevator to the working side of the packaging machine (20).

7. Apparatus according to claim 6, characterized in that, adjacent to the end of the cross-conveyor (47, 68) and to the end of the conveyor belts (60, 61), is a lowering conveyor (48) for conveying the blank stacks (22) to the blank magazine (23), said lowering conveyor (48) comprising a supporting web (66) which is movable up and down movable transversely and on which a blank stack (22) rests during downward movement.

8. Apparatus according to claim 7, characterized in that, at the delivery end of the conveyor belts (60, 61) of the cross-conveyor (47, 68), is arranged a pick-up and transfer member for the blank stacks (22), in the form of two pivotable lateral supporting arms (63, 64) with supporting legs (65), in which the blank stack (22) rests after being delivered by the conveyor belt (60, 61), the supporting arms (63, 64) being pivotable out of a pick-up position into a delivery position.

9. Apparatus according to claim 6, characterized in that two cross conveyor (47, 68) are arranged parallel and next to one another and are fed by means of a common elevator (45), the cross-conveyor (47, 68) being connected to one another by means of a connecting platform (67) for transferring blank stacks (22).

10. Apparatus according to claim 6, wherein said cross-conveyor transports the blank stack from the rear of the packaging machine to the front thereof.

* * * * *